US010100530B1

(12) United States Patent
Clark

(10) Patent No.: US 10,100,530 B1
(45) Date of Patent: Oct. 16, 2018

(54) METHOD AND APPARATUS FOR CONSTRUCTION OF EXTERIOR WALL SYSTEM

(71) Applicant: Robert A. Clark, Fairhope, AL (US)

(72) Inventor: Robert A. Clark, Fairhope, AL (US)

( * ) Notice: Subject to any disclaimer, the term of this patent is extended or adjusted under 35 U.S.C. 154(b) by 0 days.

(21) Appl. No.: 15/654,935

(22) Filed: Jul. 20, 2017

(51) Int. Cl.
*E04F 13/08* (2006.01)
*E04B 1/70* (2006.01)
*E04B 1/32* (2006.01)

(52) U.S. Cl.
CPC ..... *E04F 13/0864* (2013.01); *E04B 1/7038* (2013.01); *E04F 13/0826* (2013.01); *E04B 2001/3276* (2013.01); *E04B 2103/06* (2013.01)

(58) Field of Classification Search
CPC ..... E04F 13/0864; E04F 13/0826; E04B 1/7038; E04B 2001/3276
USPC ..... 52/58, 459, 520, 545, 716.8, 254, 265, 52/267, 293.1, 293.3, 479, 481.1, 781.3
See application file for complete search history.

(56) References Cited

U.S. PATENT DOCUMENTS 2,249,125 A * 7/1941 Gabriel ..... E04D 13/15 52/553
2,483,888 A * 10/1949 Danielson ..... E04F 13/06 4/538
3,349,533 A * 10/1967 Gregoire ..... E04B 2/7854 52/282.2
3,494,085 A * 2/1970 Van Bael ..... E04F 13/06 52/254
3,568,391 A * 3/1971 Conway ..... E04B 1/7023 52/364
D248,327 S * 6/1978 South ..... D25/119
4,485,600 A 12/1984 Olson
4,837,991 A * 6/1989 Shaw ..... E02D 31/02 52/169.5
5,003,743 A * 4/1991 Bifano ..... E04F 13/06 52/288.1
5,634,305 A * 6/1997 Erlanger ..... E04B 2/86 52/235
5,675,955 A * 10/1997 Champagne ..... E04F 13/0864 52/519
5,836,135 A * 11/1998 Hagan ..... E04B 1/762 52/836
5,884,435 A * 3/1999 David ..... E04F 19/061 52/302.6
5,937,600 A 8/1999 Larson
5,946,870 A * 9/1999 Bifano ..... E04B 1/765 52/254
6,134,847 A * 10/2000 Bifano ..... E04B 1/765 52/101
6,293,064 B1 * 9/2001 Larson ..... E04B 1/762 52/209

(Continued)

*Primary Examiner* — Brian E Glessner
*Assistant Examiner* — Adam G Barlow
(74) *Attorney, Agent, or Firm* — George L Williamson

(57) ABSTRACT

Method and apparatus useful for the construction of exterior wall systems of buildings. The apparatus has an outer U-channel having a front formed lip thereon along with an inner wall together forming a base portion of the U-channel within which the bottom of the outer piece of siding is placed. The apparatus also includes a rear wall for supporting the inner piece of siding in an upright position along with a ledge upon which the bottom of the inner piece of siding rests. The rear wall of the apparatus may have apertures herein for receiving fasteners along with weep holes in the base of the U-channel.

14 Claims, 5 Drawing Sheets

(56) References Cited

U.S. PATENT DOCUMENTS 6,298,609 B1 * 10/2001 Bifano ..... E04B 1/765 52/101
6,314,695 B1 * 11/2001 Belleau ..... E04F 13/06 427/294
6,338,229 B1 * 1/2002 Botzen ..... E04F 13/06 52/287.1
6,385,932 B1 * 5/2002 Melchiori ..... E04F 13/06 52/302.3
6,470,638 B1 * 10/2002 Larson ..... E04B 1/765 52/254
6,505,448 B2 * 1/2003 Ito ..... E04F 13/0803 52/302.1
6,591,559 B2 * 7/2003 Contreras ..... E04B 1/762 43/1
6,698,144 B1 * 3/2004 Larson ..... E04B 1/765 52/202
7,383,669 B2 * 6/2008 Morse ..... E04F 13/0864 52/459
7,634,883 B1 * 12/2009 Larson ..... E04F 13/06 52/393
8,316,600 B2 * 11/2012 Wendt ..... E04B 9/30 52/287.1
8,869,491 B2 * 10/2014 Little ..... E04F 13/06 52/255
9,003,576 B2 * 4/2015 Rubin ..... A47K 17/022 4/559
D740,968 S * 10/2015 Stanfill ..... D25/119
9,366,040 B2 * 6/2016 Singh ..... E04F 19/065
9,540,808 B2 * 1/2017 Remmele ..... E04F 13/068
D792,609 S * 7/2017 Smith ..... D25/119
2004/0237443 A1 12/2004 Haley et al.
2006/0179747 A1 8/2006 Creech
2006/0272258 A1 12/2006 Pollock
2008/0172978 A1 * 7/2008 Caruso ..... E04B 2/60 52/716.8
2009/0183453 A1 7/2009 Koessler et al.
2010/0088987 A1 * 4/2010 Monteer ..... E04F 13/0812 52/302.6
2015/0059272 A1 * 3/2015 Husler ..... E04B 2/56 52/302.3

* cited by examiner

METHOD AND APPARATUS FOR CONSTRUCTION OF EXTERIOR WALL SYSTEM

BACKGROUND OF THE INVENTION

Field of the Invention

The present invention relates generally to construction materials and, more particularly, is concerned with an apparatus used for construction of exterior wall systems including the installation of large panels of siding.

Description of the Related Art

Devices relevant to the present invention have been described in the related art, however, none of the related art devices disclose the unique features of the present invention.

In U.S. Patent Application Publication No. 2004/0237443 dated Dec. 2, 2004, Haley, et al., disclosed brackets for supporting and aligning wall members for attachment. In U.S. Pat. No. 5,937,600 dated Aug. 17, 1999, Larson disclosed an exterior wall system and drip channel. In U.S. Pat. No. 6,470,638 dated Oct. 29, 2002, Larson disclosed a moisture management system. In U.S. Patent Application Publication No. 2009/0183453 dated Jul. 23, 2009, Koessler, et al., disclosed an apparatus for providing air flow in a building wall. In U.S. Pat. No. 4,485,600 dated Dec. 4, 1984, Olson disclosed a compressible spacing and sealing apparatus for siding panel joints. In U.S. Patent Application Publication No. 2006/0179747 dated Aug. 17, 2006, Creech disclosed a method and apparatus for integral modular masonry flashing. In U.S. Patent Application Publication No. 2006/0272258 dated Dec. 7, 2006, Pollock disclosed a break-away siding clip (reversible). In U.S. Pat. No. 5,884,435 dated Mar. 23, 1999, David, et al., disclosed stepped flashing for siding panels.

While these devices may be suitable or the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses an apparatus useful for the construction of exterior wall systems of buildings, for example, residential homes and commercial buildings. The wall system would include a plurality of outside sheets of siding such as would be used for the outer wall siding for a residential building. The apparatus is several feet long and is expected to be constructed of some type of metal material, e.g., sheet metal, although other types of material could be used, for example, plastic or the like. First, the apparatus has an outer U-channel having a front or forwardly formed lip thereon along with an inner wall together forming a base portion of the U-channel within which the bottom of the outer or front piece of siding or panel would be placed. Next, the apparatus includes a rear wall for supporting the inner or rear piece of siding in an upright position along with a ledge upon which the bottom of the piece of siding rests. The outer piece of siding rests in the base or bottom of the outer U-channel and the inner piece of siding rests on the ledge. The rear wall of the apparatus can have vertically oriented slots or holes therein through which fasteners are used for attachment of the rear wall to the outer frame of the building, such as for example, a bottom plate of the building wall. Weep holes may also be placed in the bottom or base of the U-channel in order to remove moisture from the wall of the building.

An object of the present invention is to provide an apparatus for supporting the outer panels or sheets of material which could comprise the outer wall of a building. A further object of the present invention is to provide an apparatus which can be easily attached to the outer portion of the bottom plate or like of a building. A further object of the present invention is to provide an apparatus for removing trapped moisture from the outer wall or siding of a building using weep holes. A further object of the present invention is to provide an apparatus which can be easily operated by a user. A further object of the present invention is to provide an apparatus for installing outer panels on the outer wall system of a building which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
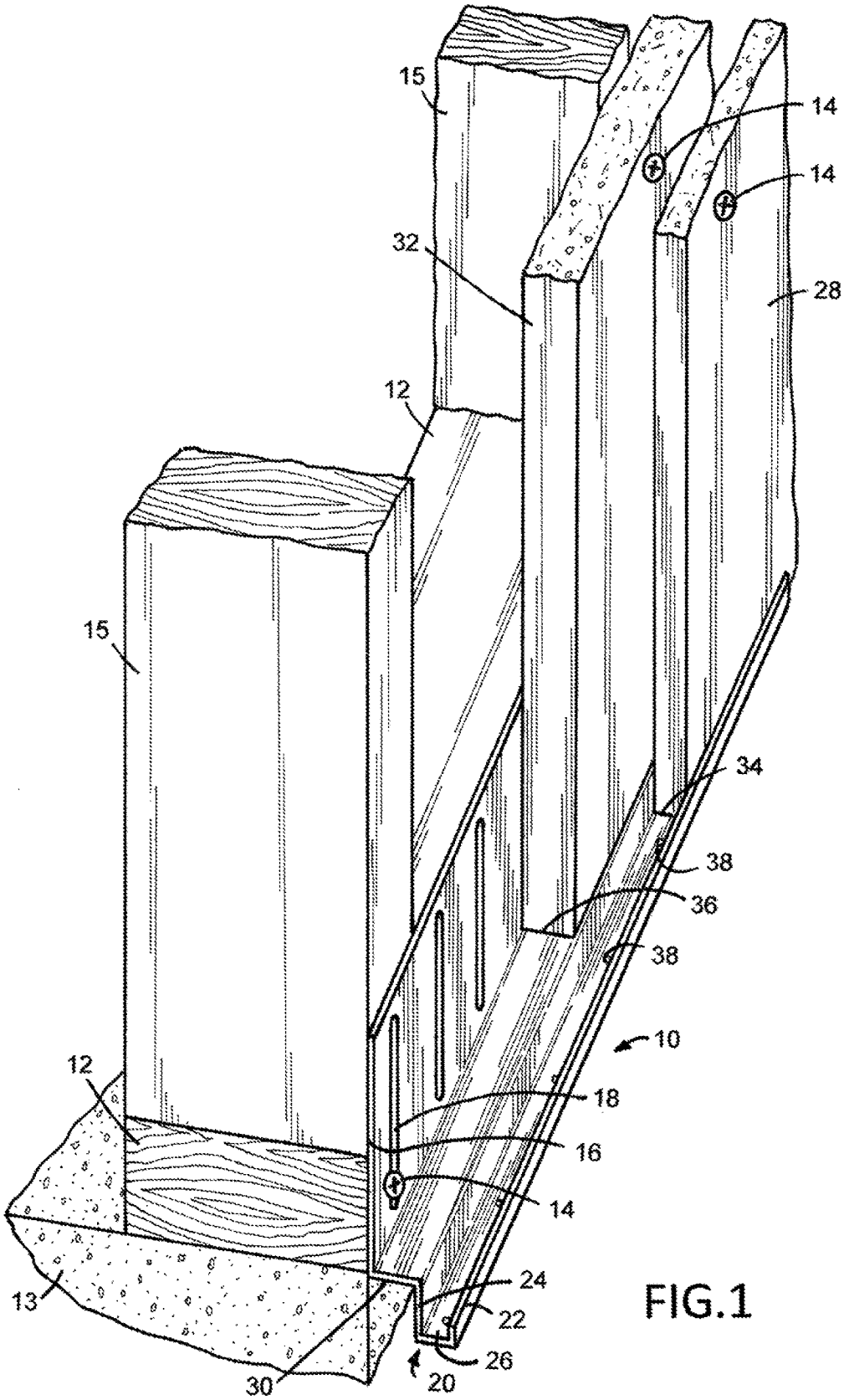
FIG. 1 is a perspective view of the present invention shown in operative connection.

With regard to reference numerals used, the following numbering is used throughout the drawings.

10 present invention
12 base plate
13 foundation
14 fastener
15 upright wall stud
16 inner/rear vertical wall
18 aperture/slot
20 U-channel portion
22 front lip
24 intermediate vertical wall
26 base portion
28 outer piece of siding
30 ledge

32 inner piece of siding
34 lower edge of siding
36 lower edge of siding
38 weep hole

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein an apparatus for the construction of an exterior wall system is disclosed and which is generally indicated by reference number 10.

Figure 2:
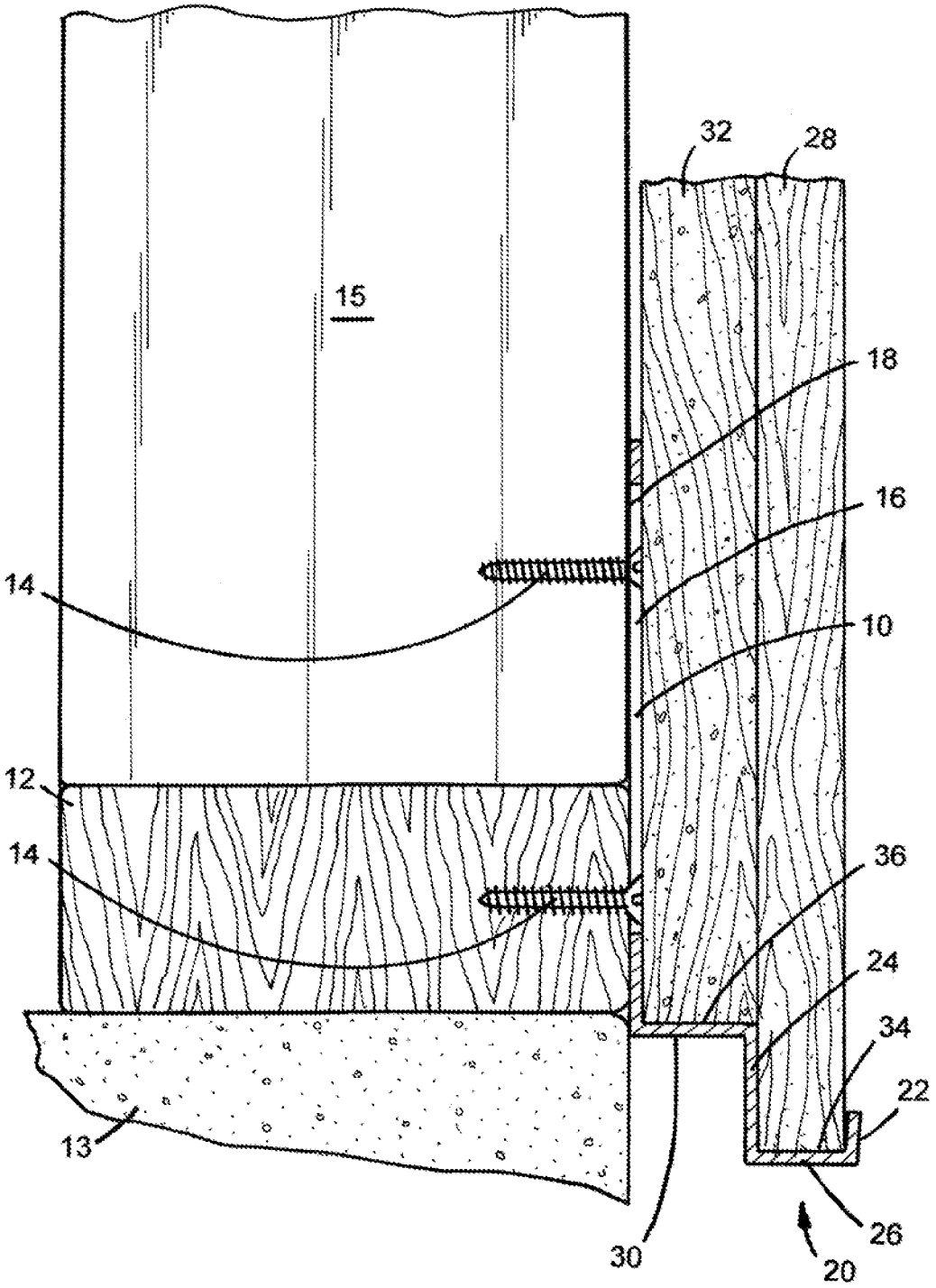
FIG. 2 is an elevation view of the present invention.

Turning to FIGS. 1-2, therein is shown the present invention 10 mounted onto the outer surface portion of a base plate 12 by using a plurality of fasteners 14. The base plate 12 is typically constructed of wood and may include a 2×4 base plate member and is commonly supported by a foundation 13 which may be concrete or the like. An upright standing 2×4 stud or wall stud 15 is also shown. The fasteners 14 could be of any type including screws, nails or staples or the like. The present invention 10 has a vertically extending inner or rear wall 16 through which the fasteners 14 are placed so as to attach the present invention to the outer portion of the base plate 12. Rear wall 16 extends parallel to and contiguous to the rear surface of the inner piece of siding 32. The fasteners 14 pass through a plurality of spaced apart apertures or slots 18 placed in the rear wall 16 of the present invention 10 which slots extend substantially the entire length of the wall 16 so as to provide maximum opportunity for attachment of the present invention 10. The present invention 10 also includes an outer U-channel like portion 20 which is defined by a near-vertical front or outer lip 22 and a vertical inner wall section 24 so that the lip and inner wall form the U-channel 20 having a base portion 26 therein which is sized and shaped to receive the bottom edges of the front or outer piece of siding 28. The present invention 10 also includes a ledge-like portion 30 which is designed so that the inner piece of siding 32 can rest on the ledge 30 so as to be sandwiched between the outer piece of siding 28 and the rear wall 16 of the present invention 10 wherein the elevation of the ledge-like portion is higher than the base portion 26 to allow moisture to migrate down to the base portion 26. It should be seen that the bottom edge 34, 36 of the outer and inner siding 28, 32 rests on the present invention 10 so that the pieces of siding are contiguous to each other. A plurality of optional spaced apart weep holes 38 are also shown in the base portion 26 of the U-channel 20.

Figure 3:
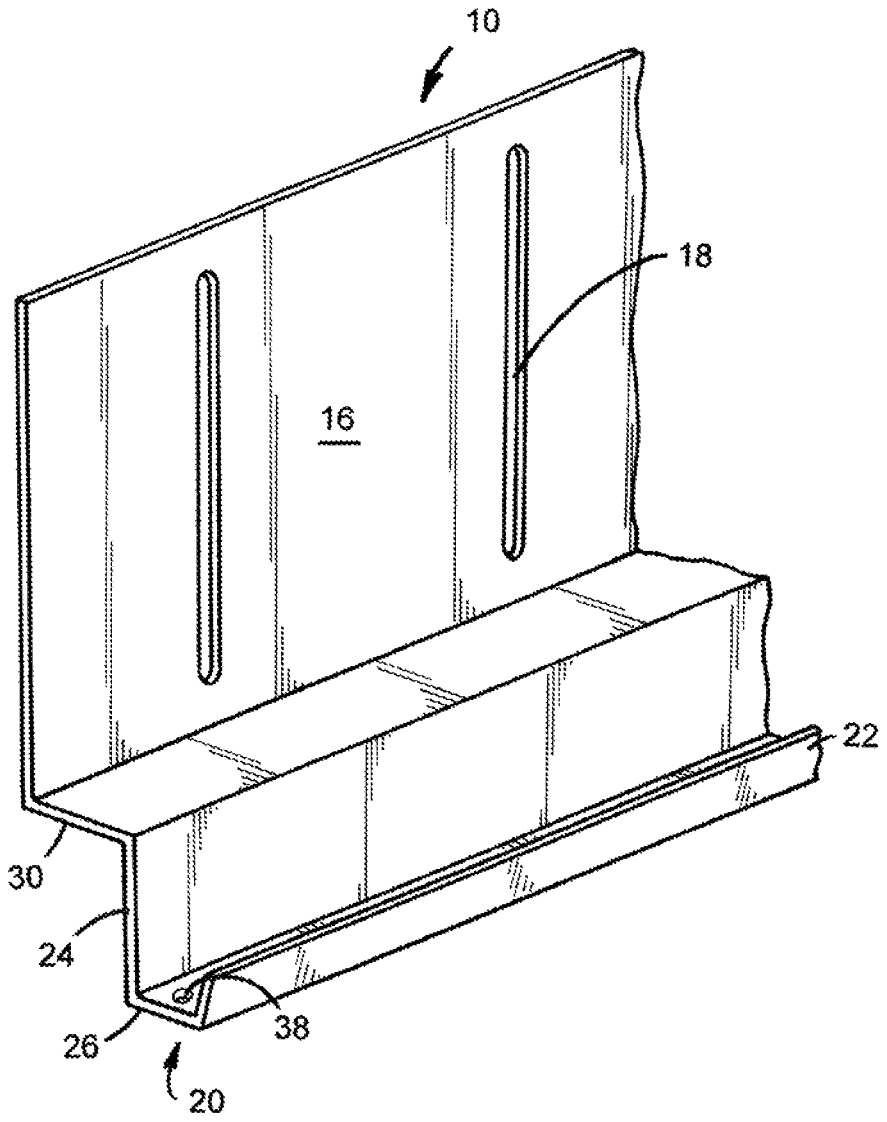
FIG. 3 is a perspective view of a portion of the present invention.
Figure 4:
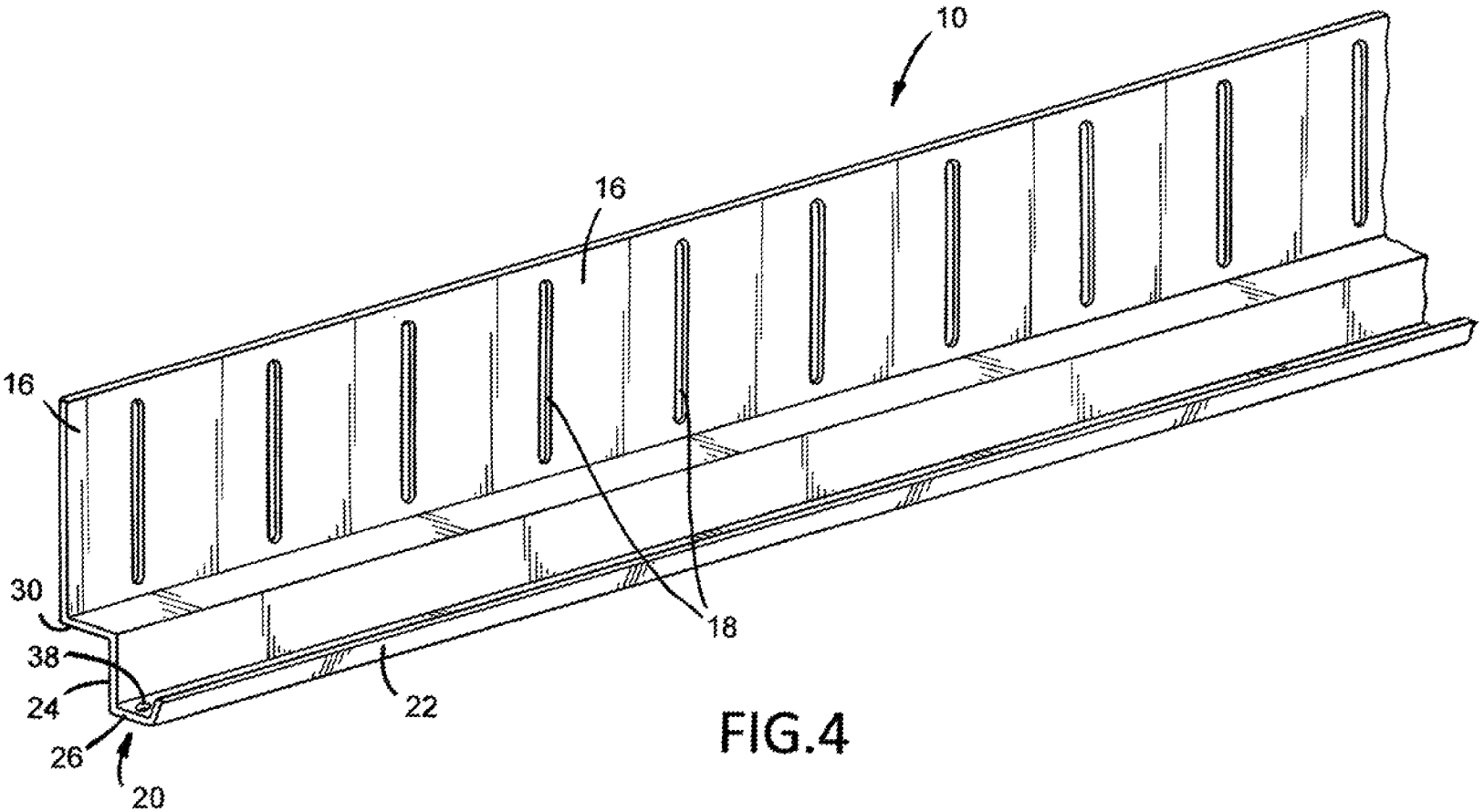
FIG. 4 is a perspective view of an elongated portion of the present invention.
Figure 5:
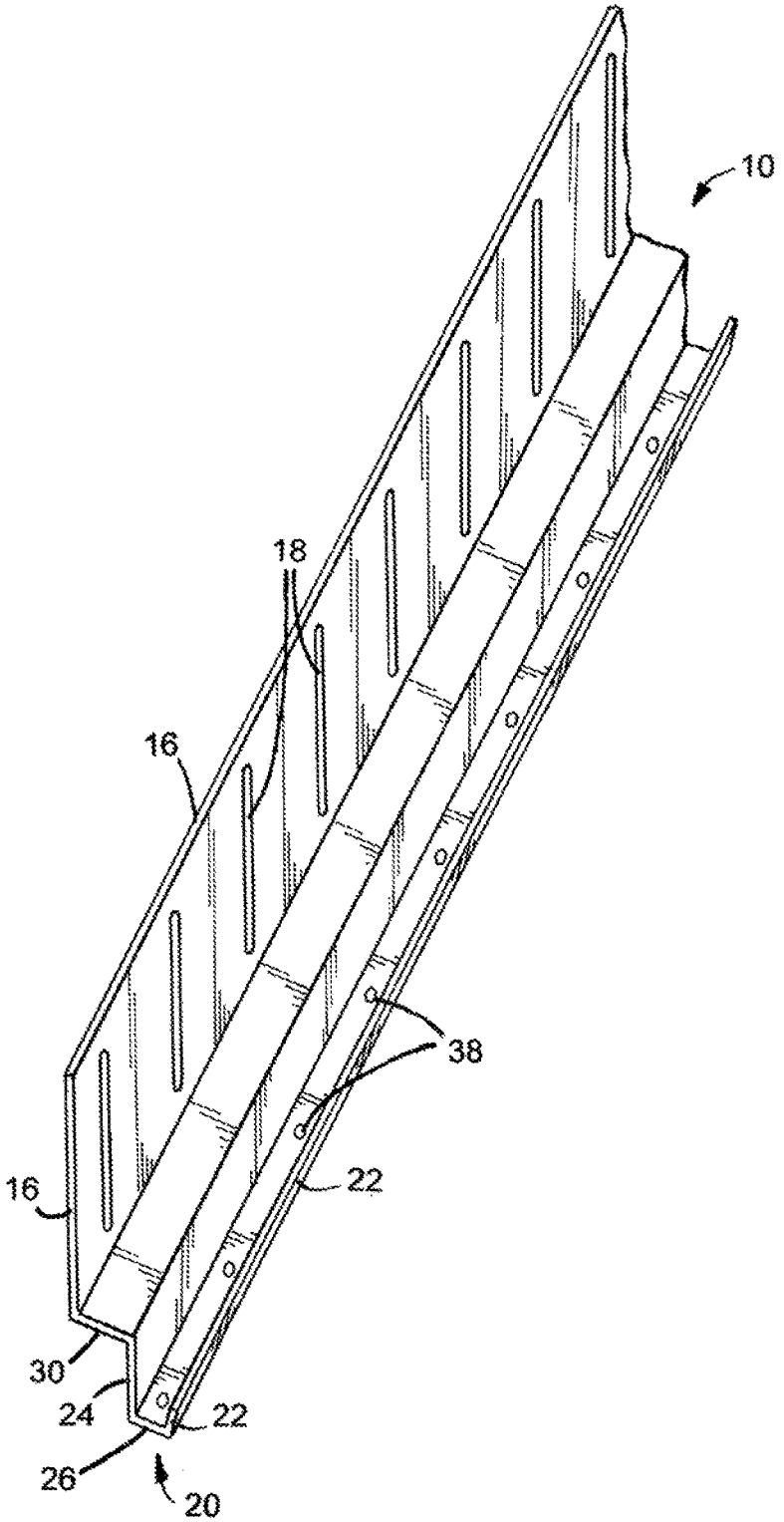
FIG. 5 is a perspective view taken from the top of the present invention.

Turning to FIGS. 3-5, therein is shown the present invention 10 including its parts as previously disclosed wherein the rear wall 16 is shown, the apertures 18 through which fasteners are extended, the outer or front lip 22, the inner wall 24, forming U-channel 20 and the base of the U-channel 26 along with weep holes 38 which are provided in the U-channel in order to allow moisture to be removed from the outer wall system as needed. Also shown is the ledge 30 of the present invention 10 positioned between the rear wall 16 and the inner wall 24 of the U-channel portion 20 of the present invention 10.

In operation, the first piece of the present invention 10 is attached to the base plate 12 of a wall section of a building and immediately next to the first piece is placed or installed a succeeding piece of the present invention 10 so that a series of pieces are installed around the lower part of a building wall. Each piece of the present invention is expected to be 6 to 20 feet in length so that a plurality of pieces of siding can be placed upon the present invention 10. After the pieces of the present invention 10 are attached to the base plate 12 of the buildings the pieces of siding are then placed in their appropriate place on the present invention 10 so that an inner piece of siding 32 is first placed and supported on the present invention and then the second or outer piece of siding 28 would then be placed in the base portion 26 of the present invention 10 so that together the pieces of siding 28, 32 can form the outer wall system of a building. A major advantage of the present invention 10 is that a single person can install the two pieces of siding 28, 32 using the present invention 10. Conventional methods of construction require at least two people to pick up and install the pieces of siding 28, 32 because there is no means of supporting the pieces of siding in its proper upright position on the outer wall of the building as does the present invention 10. In contrast, the present invention 10 allows a single installer to pick up a piece of siding, set its bottom edge on the present invention 10, hold the siding upright with one hand against the stud wall and tack it with the other hand and then complete the installation of the single piece of siding.

The inner piece of siding 32 may be oriented strand board (OSB), plywood or the like and the outer piece of siding 28 may be Hardie board, fiber cement board or the like. Any other suitable material may also be used for the inner 32 and outer 28 piece of siding. The pieces of siding 28, 32 that may be used with the present invention 10 are quite large and one size that is common is four feet×eight feet; also, lap siding may be used with the present invention 10.

The present invention 10 is designed so that the rear wall is expected to have a substantially vertical orientation so that the outer lip 22 also has an upward or near vertical orientation whereas the base portion 26 and ledge 30 have a horizontal disposition so as to receive the corresponding bottom edges 34, 36 of the pieces of siding 28, 32, thereon.

By way of summary and by making reference to FIGS. 1-5, the present invention 10 discloses a method for construction of an exterior wall system, the exterior wall system for attachment to a building frame, the building frame having a base plate 12 and framing studs 15, including the steps of: providing an inner vertical wall 16 having a plurality of spaced apart apertures 18 therein, the apertures for receiving fasteners 14 therein for attaching the inner vertical wall to the building frame; forming a ledge 30 extending outwardly from and perpendicularly to a lower end of the inner vertical wall so that a lower edge 36 of a first siding panel 32 can be supported on the ledge; forming a U-channel portion 20 defined by an intermediate vertical wall 24, a base portion 26, and a front lip 22; and, extending the intermediate vertical wall downwardly from a front edge of the ledge wherein the base portion extends outwardly from and perpendicularly to a lower end of the intermediate vertical wall, wherein the front lip extends upwardly from and substantially perpendicularly to a front edge of the base portion so that a lower edge 34 of a second siding panel 28 can be supported on the base portion. Also, further comprising the step of attaching the inner vertical wall to the building frame with a plurality of fasteners, and, disposing the first siding panel between the building frame and the second siding panel. Also, attaching the first and second siding panels to the building frame with a plurality of fasteners and providing weep holes 38 in the base portion so that moisture drains from the apparatus, and, wherein the ledge and the lower edge of the first siding panel are substantially the same width, and, wherein the base portion and the lower edge of the second siding panel are substantially the same width.

I claim:

1. An exterior wall system of a building comprising:

a) a foundation having a base plate;

b) a plurality of spaced, vertically extending studs extending up from said base plate;

c) apparatus mounted on an outer surface of said base plate and extending up from said base plate and spanning adjacent studs for supporting a pair of sidings forming said exterior wall of said building;

d) said apparatus having an inner vertical wall having a plurality of spaced apart apertures therein, and fasteners extending through said apertures for attaching said inner vertical wall to said studs;

e) a ledge extending outwardly from and perpendicularly to a lower end of said inner vertical wall supporting a lower edge of a first siding;

f) a U-channel portion defined by an intermediate wall extending downwardly from an outer edge of said ledge, a base portion extending horizontally from a lower edge of said intermediate wall, and a front lip extending up from an outer edge of said base portion; and g) a lower edge of a second siding supported on and captured in said base portion of said U-channel portion.

2. The exterior wall system of claim 1, wherein said apertures comprise vertically extending slots aligned with said studs.

3. The exterior wall system of claim 2, wherein the first siding is disposed between said studs and the second siding.

4. The exterior wall system of claim 3, wherein the first and second sidings are attached to the studs by a plurality of said fasteners.

5. The exterior wall system of claim 4, said base portion has a weep hole therein to permit moisture to drain from the apparatus.

6. The exterior wall system of claim 1, wherein said ledge and said lower edge of said first siding are substantially the same width.

7. The exterior wall system of claim 1, wherein said base portion and said lower edge of said second siding are substantially the same width.

8. A method for constructing an exterior wall system of a building, comprising the steps of:

a) mounting a base plate on a foundation for said building;

b) attaching a plurality of spaced, vertically extending studs extending up from said base plate;

c) mounting apparatus on an outer surface of said base plate, said apparatus extending up from said outer surface and spanning adjacent studs, for supporting a pair of sidings forming said exterior wall of said building;

d) said apparatus having an inner vertical wall with spaced apart apertures therein, and using fasteners therein for attaching the inner vertical wall to said studs;

e) said apparatus having a ledge extending outwardly from and perpendicularly to a lower end of the inner vertical wall for supporting a first siding;

f) said apparatus forming a U-channel portion defined by an intermediate vertical wall extending downwardly from an outer edge of said ledge, a base portion, and a front lip extending up from an outer edge of said base portion; and g) supporting a second siding by mounting a bottom edge of said second siding in said U-channel portion whereby said first and second sidings are flush against outer surfaces of said studs.

9. The method of claim 8, further comprising the step of attaching the first and second sidings to said studs using a plurality of fasteners extending through said sidings and said apertures.

10. The method of claim 9, further comprising the step of disposing the first siding between the studs and the second siding.

11. The method of claim 10, wherein said apertures comprise vertically extending slots aligned with said studs.

12. The method of claim 11, further comprising the step of providing weep holes in the base portion so that moisture drains from the apparatus.

13. The method of claim 8, wherein the ledge and the lower edge of the first siding are substantially the same width.

14. The method of claim 8, wherein the base portion and the lower edge of the second siding are substantially the same width.

* * * * *